US010823480B2

(12) United States Patent
Bento et al.

(10) Patent No.: US 10,823,480 B2
(45) Date of Patent: Nov. 3, 2020

(54) AIR FLOW MECHANISM FOR COMPARTMENT

(71) Applicant: WHIRLPOOL CORPORATION, Benton Harbor, MI (US)

(72) Inventors: Edson Isaltino Bento, Joinville (BR); Luis Afrânio Alves Ferreira, Joinville (BR); Andrei Tres, Benton Harbor, MI (US); Daniel C. Carvalho, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 493 days.

(21) Appl. No.: 15/665,995

(22) Filed: Aug. 1, 2017

(65) Prior Publication Data

US 2019/0041118 A1 Feb. 7, 2019

(51) Int. Cl.

| | |
|---|---|
| ***F27D 11/04*** | (2006.01) |
| ***F27D 19/00*** | (2006.01) |
| ***F27B 9/28*** | (2006.01) |
| ***F27D 7/06*** | (2006.01) |
| ***F25D 17/04*** | (2006.01) |

(Continued)

(52) U.S. Cl.

CPC ..... *F25D 17/045* (2013.01); *F25D 17/065* (2013.01); *F25D 23/069* (2013.01); *F25D 25/02* (2013.01); *F25D 2317/061* (2013.01); *F25D 2317/0672* (2013.01)

(58) Field of Classification Search

CPC .... F25D 23/069; F25D 17/045; F25D 17/065; F25D 25/02; F25D 2317/0672; F25D 2317/061

See application file for complete search history.

(56) References Cited

U.S. PATENT DOCUMENTS

| | | | |
|---|---|---|---|
| 774,117 | A | 11/1904 | Tandy |
| 2,282,342 | A | 5/1942 | Preble |

(Continued)

FOREIGN PATENT DOCUMENTS

| | | | |
|---|---|---|---|
| BR | PI0100491 | B1 | 6/2009 |
| BR | PI0805999 | A2 | 6/2010 |

(Continued)

OTHER PUBLICATIONS

European Search Report dated Apr. 23, 2019 for European Application No. EP 18185263.

(Continued)

*Primary Examiner* — Steven S Anderson, II

(74) *Attorney, Agent, or Firm* — Price Heneveld LLP

(57) ABSTRACT

A compartment assembly for a refrigerator includes a housing subassembly defining a generally enclosed area, an air outlet in fluid communication with the enclosed area, and a divider unit separating the enclosed area into first and second compartments. The divider unit includes a central wall aligned with the air outlet and exposing respective portions of the air outlet to the first and second compartments. A flap is disposed within the air outlet and is rotatable about an articulation point aligned with respect to the central wall and with a body of the flap extending in an upstream direction within the air outlet. A control element is mounted external to the enclosed area and is operably coupled with the flap to drive rotation thereof.

20 Claims, 5 Drawing Sheets

(51) Int. Cl.

| | |
|---|---|
| ***F25D 17/06*** | (2006.01) |
| ***F25D 23/06*** | (2006.01) |
| *F25D 25/02* | (2006.01) |

(56) References Cited

U.S. PATENT DOCUMENTS 2,412,904 A 12/1946 Money et al.
2,434,117 A 1/1948 Money et al.
2,466,360 A 4/1949 Bitney
2,509,592 A 5/1950 Giffard
2,517,385 A 8/1950 Clark
2,573,272 A 10/1951 Petkwitz
2,597,267 A 5/1952 Shoemaker et al.
2,694,906 A 11/1954 Didion
2,710,993 A 6/1955 Kirkpatrick
2,737,782 A 3/1956 Antico
2,742,559 A 4/1956 Edelman
2,748,573 A 6/1956 Staebler et al.
2,773,677 A 12/1956 Hinkel
2,804,068 A 8/1957 Miller et al.
2,841,132 A 7/1958 Philipp
2,875,016 A 2/1959 Fry
3,410,260 A 11/1968 Morgan
3,866,437 A * 2/1975 Spencer ..... F25D 17/045 62/408
4,638,644 A 1/1987 Gidseg
4,732,435 A 3/1988 Bailey et al.
4,834,557 A 5/1989 Dreinhoff
4,914,928 A 4/1990 Fellwock et al.
4,998,382 A 3/1991 Kostos et al.
5,362,145 A 11/1994 Bird et al.
5,415,472 A 5/1995 Brise
5,429,043 A 7/1995 Becker
5,447,146 A 9/1995 Nickerson
5,524,981 A 6/1996 Herrmann et al.
5,564,809 A 10/1996 Kane et al.
5,660,777 A 8/1997 Herrmann et al.
5,735,589 A 4/1998 Herrmann et al.
5,813,741 A 9/1998 Fish et al.
5,918,959 A 7/1999 Lee
5,946,935 A * 9/1999 Ji ..... F24F 13/06 62/408
5,947,573 A 9/1999 Tovar et al.
6,045,101 A 4/2000 Goyette et al.
6,174,482 B1 1/2001 Reames et al.
6,220,684 B1 4/2001 Bent et al.
6,474,094 B2 11/2002 Kim
6,488,347 B1 12/2002 Bienick
6,604,800 B2 8/2003 Hamilton
6,718,780 B2 * 4/2004 Cho ..... F25D 17/045 62/186
6,811,045 B1 11/2004 Masker et al.
D505,140 S 5/2005 Reed et al.
D516,100 S 2/2006 Vardon
D516,102 S 2/2006 Vardon
D523,034 S 6/2006 Vardon
7,059,693 B2 6/2006 Park
D525,633 S 7/2006 Vardon
7,070,249 B2 7/2006 Leimkuehler et al.
7,131,545 B1 11/2006 Grogan
7,178,890 B2 2/2007 Park et al.
7,188,738 B2 3/2007 Stafford et al.
7,232,194 B2 6/2007 Becke et al.
D551,262 S 9/2007 Becke
7,270,385 B2 9/2007 Mathur et al.
7,552,983 B2 6/2009 Shin
7,651,182 B2 1/2010 Eveland et al.
7,726,753 B2 6/2010 Bassi
7,748,569 B2 7/2010 Sunatori
7,748,806 B2 7/2010 Egan
7,878,344 B2 2/2011 Martin et al.
7,976,113 B2 7/2011 Gwak
D656,970 S 4/2012 Merritt
8,172,347 B2 5/2012 Lim et al.
8,240,512 B2 8/2012 Sunatori
D669,506 S 10/2012 Czach et al.
8,297,726 B2 10/2012 Ramm et al.
8,336,976 B2 12/2012 Lee
8,348,362 B2 1/2013 Candeo et al.
8,359,881 B2 1/2013 Junge et al.
8,381,949 B2 2/2013 Sunatori
8,403,438 B2 3/2013 Park et al.
8,414,095 B2 4/2013 Stewart
D692,034 S 10/2013 Seo et al.
8,562,089 B2 10/2013 Collins et al.
D694,288 S 11/2013 Hottmann et al.
D694,289 S 11/2013 Hottmann et al.
D694,292 S 11/2013 Eby et al.
8,616,665 B2 12/2013 Czach et al.
8,640,482 B2 2/2014 Lim et al.
8,726,689 B2 5/2014 Jang et al.
8,733,862 B1 5/2014 Armstrong et al.
D707,267 S 6/2014 Choi et al.
8,739,568 B2 6/2014 Allard et al.
D709,927 S 7/2014 Park et al.
8,777,341 B2 7/2014 Amaral et al.
D710,405 S 8/2014 Seo et al.
D710,406 S 8/2014 Seo et al.
D711,943 S 8/2014 Park et al.
8,833,882 B2 9/2014 Seo et al.
D714,840 S 10/2014 Yang et al.
D717,349 S 11/2014 Seo et al.
D719,986 S 12/2014 Kim et al.
8,960,826 B2 2/2015 Choo et al.
9,033,437 B2 5/2015 Klitzing et al.
D734,784 S 7/2015 Kim et al.
9,097,457 B2 8/2015 Kim
9,127,878 B2 9/2015 Gossens et al.
9,151,534 B2 10/2015 Lee et al.
D745,581 S 12/2015 Jeon et al.
9,217,601 B2 12/2015 Koo et al.
D747,369 S 1/2016 McConnell et al.
D747,370 S 1/2016 Kim et al.
D747,371 S 1/2016 Lee et al.
D747,372 S 1/2016 Kim et al.
D747,373 S 1/2016 Lee et al.
D748,165 S 1/2016 McConnell et al.
9,234,690 B2 1/2016 McCollugh et al.
9,250,010 B2 2/2016 De La Garza et al.
9,297,573 B2 3/2016 Krause et al.
D754,759 S 4/2016 McConnell et al.
9,320,368 B2 4/2016 Marotti et al.
9,328,955 B2 5/2016 Castro Solis et al.
9,339,993 B2 5/2016 Cites et al.
D761,884 S 7/2016 Austin et al.
9,488,405 B2 11/2016 Lee et al.
9,500,403 B2 11/2016 Seo et al.
9,510,679 B2 12/2016 Bhatt et al.
9,671,115 B2 6/2017 Elkasevic
2003/0020387 A1 1/2003 Wing
2004/0012314 A1 1/2004 Hay et al.
2004/0104323 A1 6/2004 Hubert et al.
2005/0073225 A1 4/2005 Kwon et al.
2006/0145577 A1 7/2006 Daley et al.
2006/0168990 A1 * 8/2006 Park ..... F25D 17/045 62/408
2006/0226751 A1 10/2006 Park
2007/0126325 A1 6/2007 Gorz et al.
2007/0245767 A1 * 10/2007 Hara ..... F16K 11/052 62/448
2008/0203041 A1 8/2008 Lim et al.
2009/0293533 A1 * 12/2009 Lim ..... F25D 25/02 62/465
2010/0024464 A1 2/2010 Hwang et al.
2010/0102693 A1 4/2010 Driver et al.
2010/0109498 A1 5/2010 Ramm et al.
2010/0219731 A1 9/2010 Candeo et al.
2011/0001415 A1 1/2011 Park et al.
2011/0072846 A1 3/2011 Engel et al.
2011/0115356 A1 5/2011 Nash et al.
2012/0018434 A1 1/2012 Gwak
2012/0091084 A1 4/2012 Amaral et al.
2012/0223038 A1 9/2012 Bean
2012/0248958 A1 10/2012 Ertz et al.

(56) References Cited

U.S. PATENT DOCUMENTS

| | | | | |
|---|---|---|---|---|
| 2013/0020922 | A1 | 1/2013 | Jang | |
| 2015/0034668 | A1 | 2/2015 | Minard et al. | |
| 2015/0061484 | A1 | 3/2015 | Jeong et al. | |
| 2015/0107084 | A1 | 4/2015 | Craycraft et al. | |
| 2015/0168048 | A1 | 6/2015 | Sexton et al. | |
| 2015/0184929 | A1 | 7/2015 | Moon | |
| 2016/0290707 | A1 | 10/2016 | Burke et al. | |
| 2017/0086580 | A1 | 3/2017 | Conti | |
| 2017/0181538 | A1 | 6/2017 | Azkue et al. | |
| 2018/0224185 | A1* | 8/2018 | Besore | F25D 17/065 |

FOREIGN PATENT DOCUMENTS

| | | | | |
|---|---|---|---|---|
| CN | 101611281 | A | 12/2009 | |
| CN | 201779952 | U | 3/2011 | |
| CN | 102135363 | A | 7/2011 | |
| CN | 102395849 | A | 3/2012 | |
| CN | 102494496 | A | 6/2012 | |
| CN | 202432813 | U | 9/2012 | |
| CN | 102829604 | A | 12/2012 | |
| CN | 102889744 | A | 1/2013 | |
| DE | 8801508 | U1 | 6/1989 | |
| DE | 10107646 | A1 | 8/2002 | |
| DE | 102009045363 | A1 | 4/2011 | |
| DE | 102013216974 | A1 | 4/2014 | |
| DE | 102012223131 | A1 | 6/2014 | |
| EP | 0577939 | A1 | 1/1994 | |
| EP | 1790250 | A2 | 5/2007 | |
| EP | 1927817 | A1 | 6/2008 | |
| EP | 1927817 | A1 * | 6/2008 | F25D 17/045 |
| EP | 1349802 | B1 | 8/2008 | |
| EP | 2072937 | A2 | 6/2009 | |
| EP | 2098810 | A2 | 9/2009 | |
| EP | 2424421 | B1 | 10/2015 | |
| EP | 2760315 | B1 | 8/2016 | |
| JP | H0462380 | A | 2/1992 | |
| JP | H10115485 | A | 5/1998 | |
| JP | H10122733 | A | 5/1998 | |
| JP | H11237173 | A | 8/1999 | |
| JP | 2002090054 | A | 3/2002 | |
| JP | 2013145082 | A | 7/2013 | |
| KR | 100431346 | B1 | 5/2004 | |
| KR | 20040095421 | A | 11/2004 | |
| KR | 100657933 | B1 | 12/2006 | |
| KR | 100756887 | B1 | 9/2007 | |
| KR | 20070116506 | A * | 12/2007 | F25D 25/025 |
| KR | 20070116506 | A | 12/2007 | |
| KR | 20100023474 | A | 3/2010 | |
| KR | 20140022598 | A | 2/2014 | |
| WO | 02014761 | A1 | 2/2002 | |
| WO | 2004104504 | A1 | 12/2004 | |
| WO | 2005012812 | A1 | 2/2005 | |
| WO | 2007128734 | A1 | 11/2007 | |
| WO | 2008015180 | A2 | 2/2008 | |
| WO | 2009155679 | A2 | 12/2009 | |
| WO | 2011009773 | A2 | 1/2011 | |
| WO | 2011080109 | A2 | 7/2011 | |
| WO | 2012025382 | A2 | 3/2012 | |
| WO | 2012062670 | A2 | 5/2012 | |
| WO | 2013126515 | A1 | 8/2013 | |
| WO | 2015101430 | A1 | 7/2015 | |
| WO | 2015101434 | A1 | 7/2015 | |
| WO | 2015149832 | A1 | 10/2015 | |
| WO | 2015165531 | A1 | 11/2015 | |
| WO | 2016155784 | A1 | 10/2016 | |
| WO | 2017005314 | A1 | 1/2017 | |

OTHER PUBLICATIONS

GE Appliances, Refrigerator Capacity & Organization: Making Room for More, Jan. 17, 2014, http://www.geappliances.com/appliances/refrigerators/refrigerator-capacity-organize.htm.

GE Appliances, GE Profile Side by Side Refrigerators, Jan. 17, 2014, http://www.abt.com/ge/GE_Profile_SideBySide.

* cited by examiner

AIR FLOW MECHANISM FOR COMPARTMENT

BACKGROUND

The present device generally relates to a compartment assembly for a refrigerator. In particular, the compartment assembly includes a mechanism for adjustably dividing air flow between separate compartments included therein.

Various mechanisms exist for the specified control of chilled air flow to specific areas or compartments of a refrigerator. In many applications, such mechanisms use an electronic control or a direct mechanical control to open or close a vent or baffle within a duct that provides the specific air flow. Additional improvements, however, may be desired, in particular to control relative air flows between adjacent compartments.

SUMMARY

In at least one aspect, a compartment assembly for a refrigerator includes a housing subassembly defining a generally enclosed area, an air outlet in fluid communication with the enclosed area, and a divider unit separating the enclosed area into first and second compartments. The divider unit includes a central wall aligned with the air outlet and exposing respective portions of the air outlet to the first and second compartments. A flap is disposed within the air outlet and is rotatable about an articulation point aligned with respect to the central wall and with a body of the flap extending in an upstream direction within the air outlet. A control element is mounted external to the enclosed area and is operably coupled with the flap to drive rotation thereof.

In at least another aspect, a refrigerator includes an interior including a first enclosed area within a portion of the interior, a chilled air source providing a flow of chilled air to the interior, and an air outlet in fluid communication with the air source and with the enclosed area. A divider unit separates the first enclosed area into first and second compartments and includes a central wall aligned with the air outlet and exposing respective portions of the air outlet to the first and second compartments. A flap is disposed within the air outlet and is rotatable about an articulation point aligned with respect the central wall and with a body of the flap extending in an upstream direction within the air outlet. A control element is mounted external to the enclosed area and is operably coupled with the flap to drive rotation thereof.

In at least another aspect, a divider assembly for a refrigerator compartment having an air source and an air outlet in communication with the air source includes a central wall aligned with the air outlet and exposing respective portions of the air outlet to the first and second compartments. The assembly further includes a flap disposed within the air outlet and rotatable about an articulation point aligned with respect to the central wall and with a body of the flap extending in an upstream direction within the air outlet. A control element is mounted external to the enclosed area and is operably coupled with the flap to drive rotation of the flap within the air outlet into a central position. In the central position, the body of the flap is parallel with the central wall and an endpoint of the body opposite the articulation point separates the air outlet into first and second portions that are equal in area. The control element further drives rotation of the flap from the central position such that the endpoint of the body moves within the air outlet such that the first and second portions have different respective areas.

These and other features, advantages, and objects of the present device will be further understood and appreciated by those skilled in the art upon studying the following specification, claims, and appended drawings.

DETAILED DESCRIPTION OF EMBODIMENTS

Figure 1:
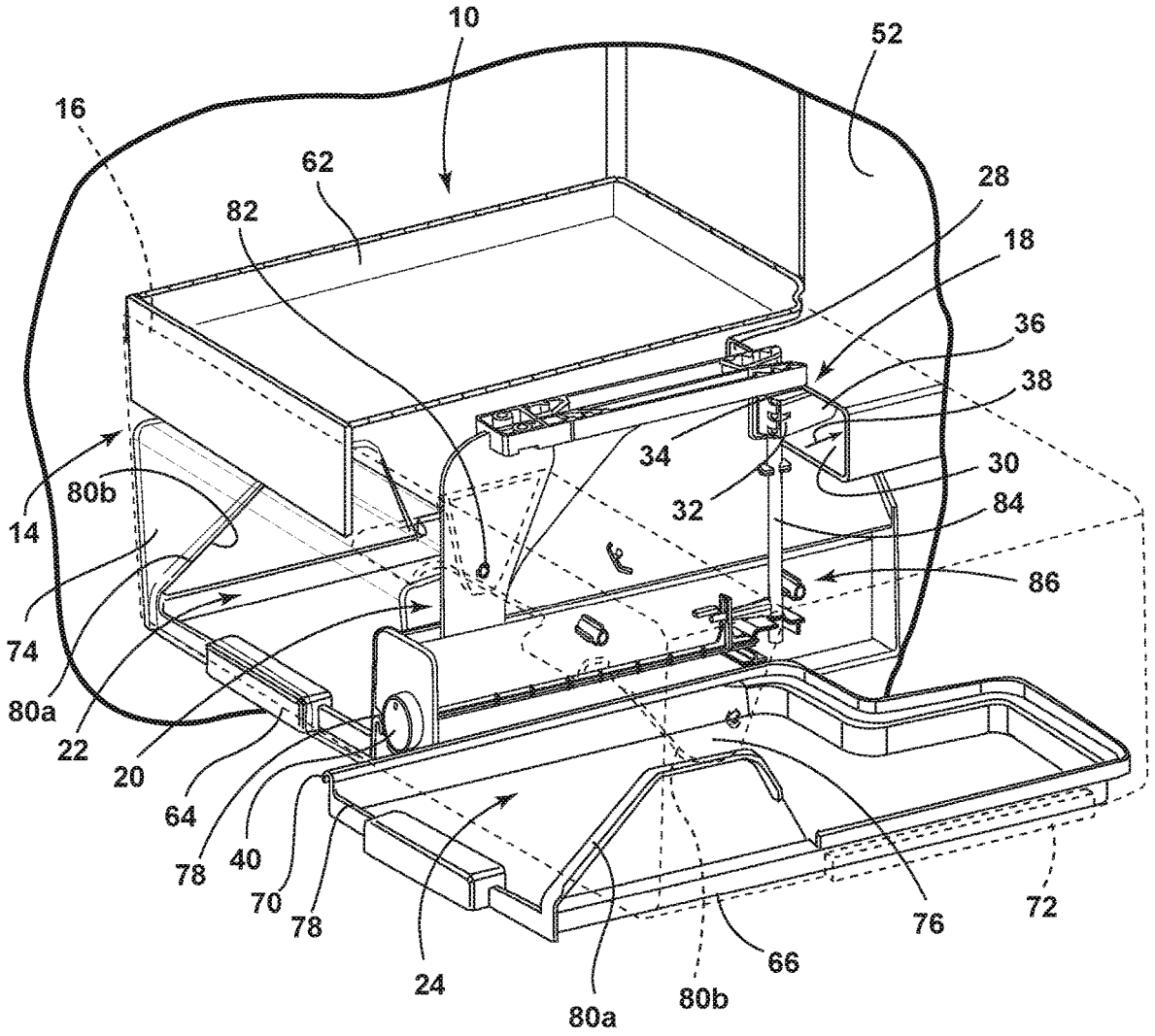
FIG. 1 is a perspective view of a compartment assembly positioned within a refrigerator interior.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to the embodiment illustrated in FIGS. 1-5C, reference numeral 10 generally designates a compartment assembly for a refrigerator 12. Compartment assembly 10 includes a housing subassembly 14 defining a generally enclosed area 16. An air outlet 18 is in fluid communication with the enclosed area 16. The housing subassembly 14 includes a divider unit 20 separating the enclosed area 16 into first and second compartments 22 and 24. The divider unit 20 includes a central wall 26 aligned with the air outlet 18 and exposing respective portions 28 and 30 of the air outlet 18 to the first and second compartments 22,24. The divider unit 20 further includes a flap 32 disposed within the air outlet 18 and rotatable about an articulation point 34 aligned with respect the central wall 26 and with a body 36 of the flap 32 extending in an upstream direction 38 within the air outlet 18. A control element 40 is mounted external to the enclosed area 16 and is operably coupled with the flap 32 to drive rotation thereof.

Figure 2:
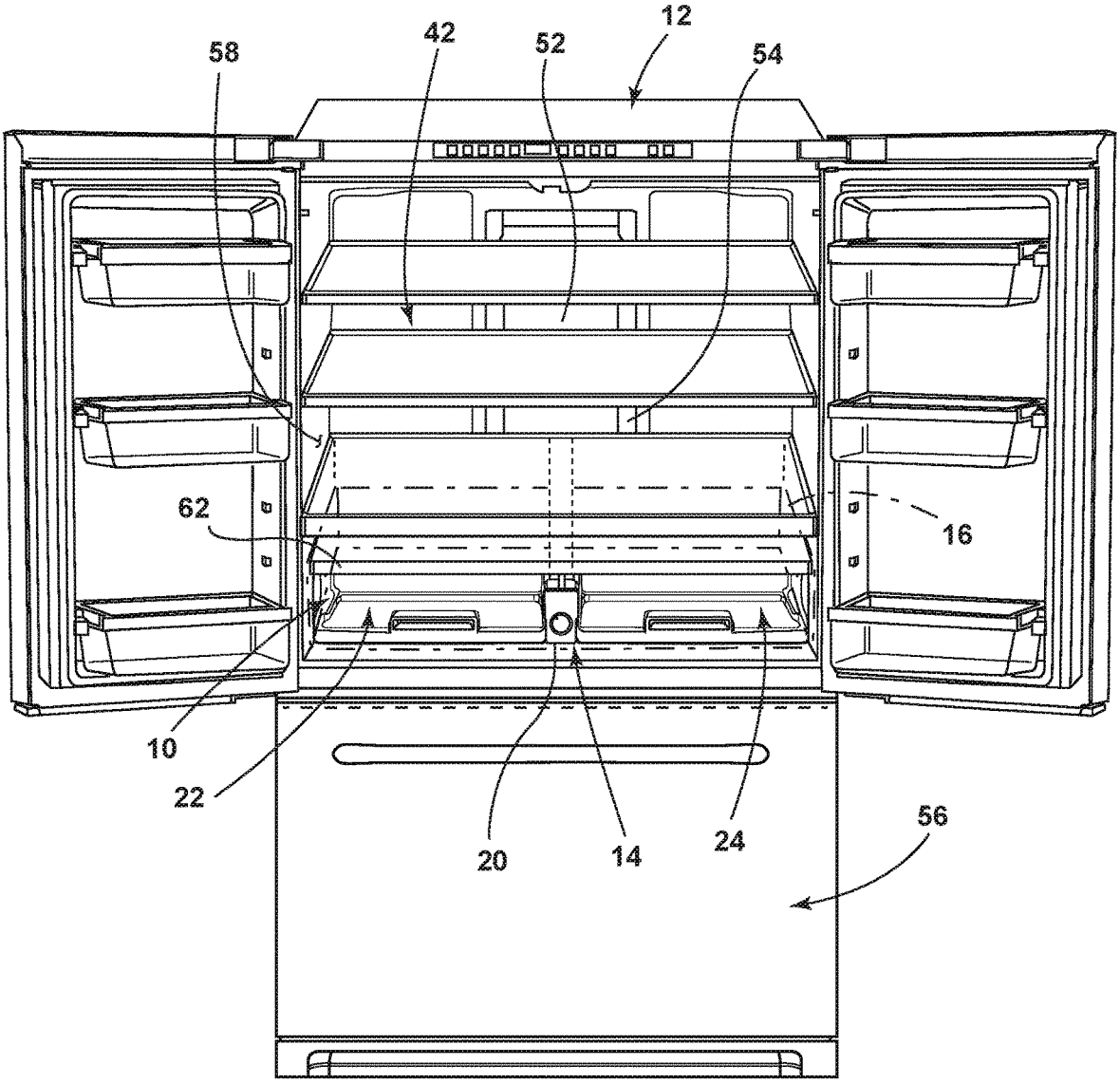
FIG. 2 is a perspective view of a refrigerator showing the interior thereof with the compartment assembly of FIG. 1 therein.

As shown in FIG. 2, the compartment assembly 10 is usable within a suitably-configured refrigerator 12, an example of which is depicted. In general, refrigerator 12 includes an interior 42 within which compartment assembly 10 is positioned and/or assembled such that the enclosed area 16 defined by the compartment assembly 10 is within a portion of the larger interior 42. In various instances, compartment assembly 10 can be removably or permanently affixed within interior 42 such as by coupling with various known configurations of movable shelving assemblies, including by incorporating mating components or features therewith. In other examples, various portions of compartment assembly 10 may be separately assembled, both movably and fixedly, within interior 42, including by incorporation of mating features within refrigerator 12 interior 42, as discussed further below. To that end, compartment assembly 10 may be generally similar to known compartment and or bin assemblies found within refrigerators, freezers, and the like.

In general, refrigerator 12 includes a chilled air source 46 for providing a chilled air to the interior 42. The chilled air source 46 will typically consist of an evaporator 48 and a fan 50 for drawing air over the evaporator 48 and forcing the resulting chilled air into the refrigerator interior 42. The chilled air flow 102 provided by fan 50 is typically introduced into the refrigerator interior 42 using various forms of ductwork adapted for the particular configuration of refrigerator 12, which can include ducts individually associated with specific areas of interior 42, including crisper drawers, in-door beverage chillers or the like. Typically, refrigerator 12 will also include an air column 52 disposed toward a rearward portion of interior 42 and extending generally along a height of the interior 42. Air column 52 is arranged in communication with the chilled air source 46 to receive at least a portion of the air flow 102 from fan 50 and includes a plurality of vents 54 therealong to divide and distribute the air flow throughout interior 42. In various implementations, refrigerator 12 can include a single evaporator 48 with ductwork for routing of the chilled air to the interior 42 of the refrigerator 12 and to an associated freezer compartment 56 with fan 50 controlling the flow of air to interior 42 and an additional fan (not show) controlling a separate flow of air to freezer 56. In other arrangements, a single fan 50 may be provided with adjustable baffles or the like being used to separate and appropriately direct chilled air, as needed based on the differing cooling requirements of the interior 42 of refrigerator 12 and the freezer compartment 56. In still further examples, chilled air source 46 can be associated with interior 42 of refrigerator 12 alone, with a separate source (including, a dedicated evaporator, for example) being associated with freezer compartment 56.

Any of the above-described arrangements can be used in the present refrigerator 12 to provide chilled air to compartment assembly 10 by way of outlet 18. In the illustrated example, outlet 18 is a conduit open to and extending from air column 52. In other examples, however, outlet 18 can be an open end of a dedicated duct extending from chilled air source 46 to the location of compartment assembly 10 within interior 42. In this manner, compartment assembly 10 is generally configured such that outlet 18 is in communication with the enclosed area 16 defined by compartment assembly 10. This communication can be accomplished by various configurations of compartment assembly 10, including by the configuration of housing subassembly 14 and the manner in which enclosed area 16 is defined within interior 42. In the present example, housing subassembly 14 can only partially define the enclosed area 16, with adjacent portions of the liner 58 that defines the interior 42 serving to bound enclosed area 16. In this manner, housing subassembly 14 can simply separate the enclosed area 16 as a portion of the larger interior 42 and portions of the liner 58 thusly separated by or otherwise surrounded by housing subassembly 14 forming corresponding portions of compartment assembly 10.

As shown in FIG. 1, housing subassembly 14 can include a plurality of horizontal members to separate the desired enclosed area 16 within interior 42 (FIG. 2). In the illustrated example, the horizontal members 60 are in the form of shelves, and are appropriately structured to support articles thereon for storage within interior 42. In particular, horizontal members 60 may consist of an upper fixed shelf 62 and two lower shelves 64 and 66 that can be associated with the first compartment 22 and second compartment 24, respectively. As shown, the lower shelves 64 and 66 can be partially supported by divider unit 20 on opposite sides thereof. In this manner, divider unit 20 can act as a structural element within housing subassembly 14, such as by being affixable (by way of screws, snap-fit arrangements or the like) with fixed shelf 62, which in turn may be supported by rails, ledges, or other features of liner 58 (FIG. 2). In other arrangements, fixed shelf 62 may be permanently affixed within liner 58, including by screws or other mechanical fasteners.

As illustrated, lower shelves 64 and 66 can be configured for sliding with respect to divider unit 20 and with respect to adjacent portions of liner 58. Various arrangements can be used to implement such sliding movement of lower shelves 64 and 66, including the inclusion of rails 68 (FIG. 3) along the lateral edges of divider unit 20, which can slidably support lower shelves 64 and 66 by way of channels 70 included thereon. Rails 68 and channels 70 can also include interengaging features to limit movement of lower shelves 64 and 66 in the outward direction so that lower shelves 64 and 66 do not become inadvertently dislodged from their supported position. Outward ledges 72 formed in or otherwise attached with liner 58 can support the outer portions of lower shelves 64 and 66 and can be structured to permit or facilitate the sliding motion.

As further shown in FIG. 1, front covers 74 and 76 can be included within housing subassembly 14 to further define enclosed area 16 closing over the front portions of the respective first and second compartments 22 and 24. Covers 74 and 76 can be movable into a closed position, as shown with respect to cover 74 in FIG. 1, wherein cover 74 is shown as contacting the front edge 78 of the corresponding lower shelf 64 and extending upwardly generally perpendicular to lower shelf 64 and toward fixed shelf 62. Covers 74 and 76 are movable out of the closed position and into an open position, as shown with respect to cover 76 in FIG. 1, wherein cover 76 is spaced apart from and generally parallel with the associated lower shelf 66 and with fixed shelf 62 such that the position between fixed shelf 62 and lower shelf 66 is accessible by a user. As further shown in FIG. 1, covers 74 and 76 and lower shelves 64 and 66 can include respective inter-operable cam surfaces 80*a* and 80*b* with the cam surfaces 80*a* associated with lower shelves 64 and 66 being positioned and shaped to engage with the cam surfaces 80*b* associated with covers 74 and 76 when lower shelves 64 and 66 are slid forward. Correspondingly, the cam surfaces 80*a* on covers 74 and 76 can be configured to cause rotation of covers 74 and 76 about hinge points 82 in the upward direction (i.e. from closed to open) when lower shelves 64 and 66 are slid forward by force of cam surface 80*b* as they move with shelves 64 and 66 in the forward direction. Conversely, when shelves 64 and 66 are pushed backwards, the inter-operable cam surfaces 80*a* and 80*b* allow covers 74 and 76 to close under the force of gravity.

The above-described configuration of housing subassembly 14 thusly defines the enclosed area 16 within interior 42, along with the portions of liner 58 between lower shelves 64 and 66 and fixed shelf 62, that is chilled by way of the air provided through outlet 18, which is disposed in communication with the enclosed area 16. It is noted that housing subassembly 14 and related additional aspects or features of compartment assembly 10 are not necessarily structured to seal enclosed area 16 or to otherwise make enclosed area 16 air-tight when covers 74 and 76 are in the closed position or otherwise. Rather, the term "enclosed" within the scope of the present disclosure means that enclosed area 16 is structured to maintain a temperature differential between each respective compartment 22,24 and between compartments 22,24 and the remainder of interior 42 achieved by the flow of chilled air through outlet 18. In this manner, portions of the housing subassembly 14 and the compartment assembly 10 overall will be open (such as around portions of shelves 62, 64, 66) to interior 42 to allow air flow 102 within the enclosed area 16 to enter interior 42 for recirculation to source of such air back to the chilled air source 46 through known structures within interior 42.

Figure 3:
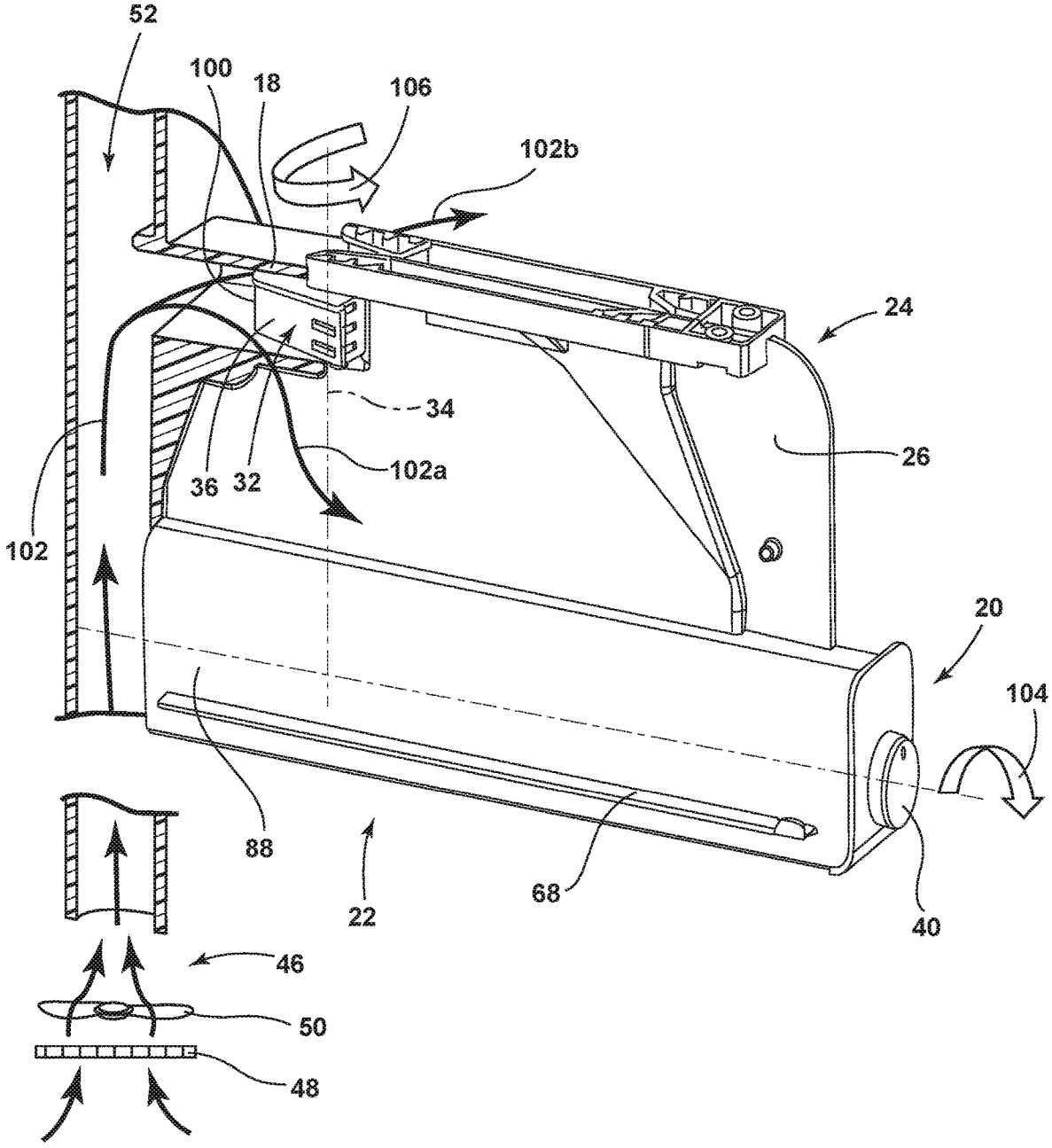
FIG. 3 is a perspective, cross-section view of a divider unit of the compartment assembly.
Figure 4:
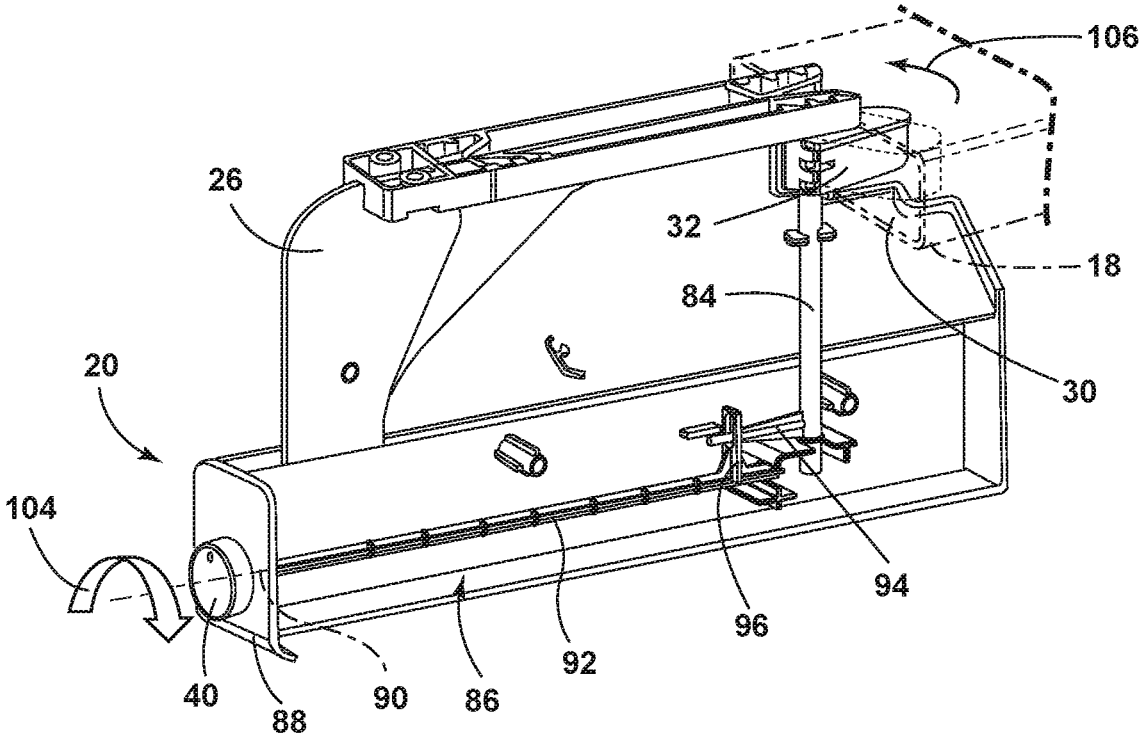
FIG. 4 is a perspective view of internal components of the divider unit of FIG. 3.

Referring now to FIGS. 3 and 4, the housing subassembly 14 is positionable about outlet 18 such that outlet 18 and the related structure thereof is effectively a part of the compartment assembly 10, as described above. In so positioning housing subassembly 14, divider unit 20 is positioned and configured to align with outlet 18 for distribution of the chilled air provided by outlet 18 among first compartment 22 and second compartment 24 and to maintain the respective air flowing into and within first compartment 22 and second compartment 24 generally isolated from each other so as to maintain the above-mentioned temperature differential between compartments 22 and 24. This is at least partially achieved by the positioning of central wall 26 of divider unit 20 in a generally centrally-aligned position with respect to outlet 18. Additionally, divider unit 20 is positioned and configured with the above-mentioned flap 32 disposed within outlet 18 and extending in upstream direction 38 (FIG. 1) therein. This positioning, along with the movable coupling of flap 32 with central wall 26 so as to be rotatable about articulation point 34, further allows divider unit 20 to create and maintain the temperature differential between first compartment 22 and second compartment 24 by altering the proportions by which the chilled air provided by outlet 18 is distributed between first compartment 22 and second compartment 24. The operative coupling between flap 32 and control element 40 allows a user to adjust the proportions by which the chilled air provided by outlet 18 is distributed between first compartment 22 and second compartment 24, thereby allowing adjustment of the resulting temperature differential (or maintaining first compartment 22 and second compartment 24 at approximately the same temperature).

Figure 5A:
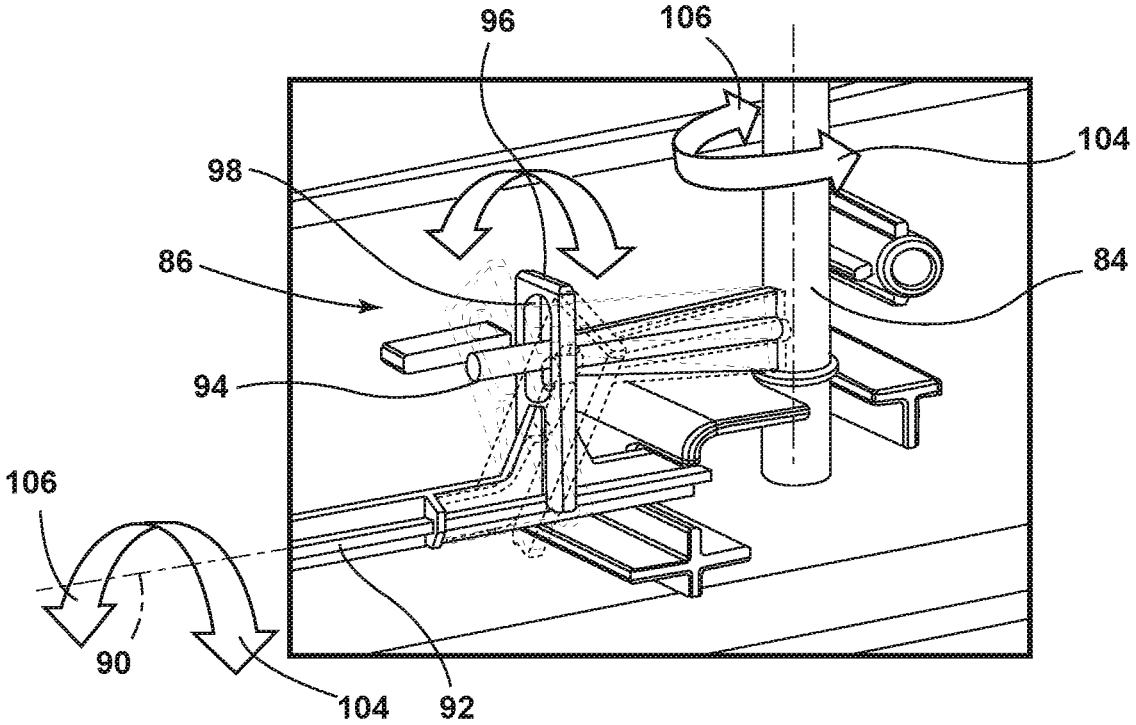
FIG. 5A is a perspective detail view of internal components of the divider unit of FIG. 4.
Figure 5B:
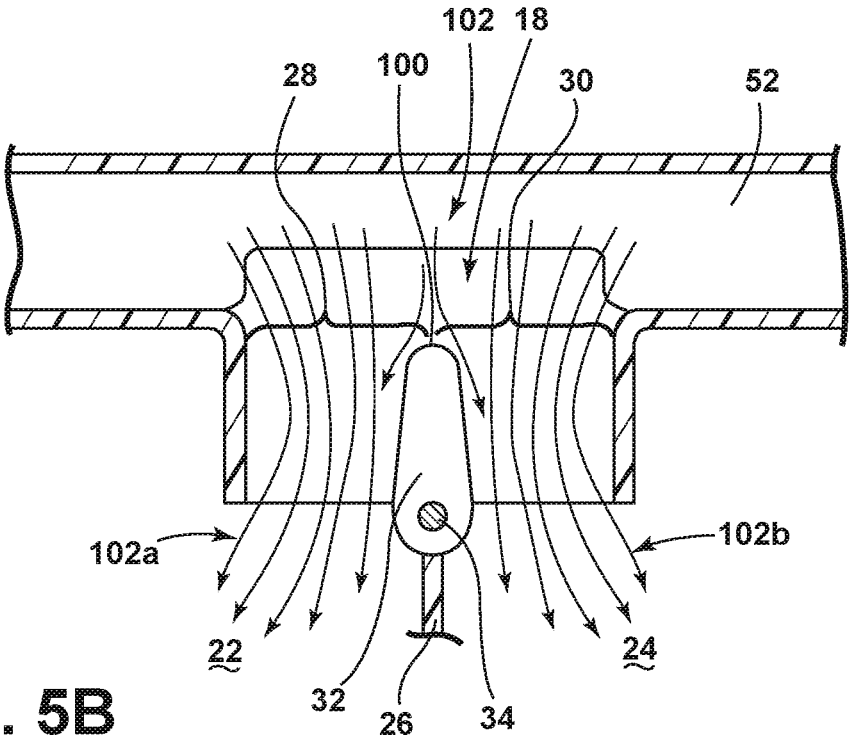
FIGS. 5B and 5C are top cross-section views of the divider unit in various positions thereof for diverting a flow of air into compartments of the compartment assembly to varying respective amounts.

The operative coupling between control element 40 and flap 32 is shown in FIGS. 4 and 5A. In particular, flap 32 is mounted on divider unit 20 by way of post 84, which is rigidly coupled with flap 32 and is rotatably retained within the interior 86 of divider, such as by appropriate mounting elements within the internal structure of the cover 88 of divider unit 20 that encloses interior 86. In one aspect, post 84 can be configured to mount and/or support flap 32 at a position to align with outlet 18 for extension thereinto. As also shown, post 84 can extend downwardly into the interior 86 of divider unit 20 to align with the general positioning of control element 40. In the embodiment show, control element 40 is in the form of a knob rotatable by a user about a central axis 90 thereof. In this manner, control element 40 is mounted on a control rod 92 that is rotatably mounted within interior 86 in a similar manner to post 84 with control rod 92 extending along axis 90 toward post 84. Control rod 92 can operably couple with post 84 by the mechanism illustrated in FIGS. 4 and 5A, which includes a post link arm 94 coupled with and extending generally perpendicularly from post 84 and a control link arm 96 coupled with and extending generally perpendicularly from control rod 92. As shown, control link arm 96 is an elongate member including a slot 98 therein, the slot 98 being positioned to align with and receive post link arm 94, which can include a cylindrical member with optional additional support as needed to transmit torque from control link arm 96 to post 84. Slot 98 is elongated within control link arm 96 to allow post link arm 94 to move with respect thereto such that rotation of control rod 92 about axis 90 is permitted while retaining post link arm 94 therein such that the rotation of control rod 92 further rotates control link arm 96 about axis 90, such rotation being transferred via slot 98 to rotation of post link arm 94 about an axis 90 extended from articulation point 34 (FIG. 3). The rotation of post link arm 94 generally perpendicular to axis 90 by rotation of control element 40 is thusly translated to rotation of post 84 and corresponding rotation of flap 32 about articulation point 34. It is noted that control element 40 can vary from the depicted knob configuration and can be replaced with a crank arm, slider or the like.

According to the above-described mechanism, flap 32 is rotatable within outlet 18 into a central position, as shown in FIGS. 4 and in 5B, wherein the body 36 (FIG. 3) of the flap 32 is parallel with or otherwise generally aligned with the central wall 26. In such a position, the endpoint 100 of the body 36, which is positioned opposite the articulation point 34 and in the upstream direction 38 (FIG. 1) therefrom, separates the outlet 18 into first and second portions 28 and 30 that are equal in area. Because divider unit 20 is generally centrally aligned with outlet 18, the centered position of flap 32 thusly evenly divides the outlet 18 and respectively associates the portions 28 and 30 thereof with the first compartment 22 and second compartment 24, respectively. As further shown in FIG. 5B, the division of outlet 18 into the respective first and second portions 28 and 30 causes the airflow 102 passing through outlet 18 to be divided by flap 32 into portions 102*a* and 102*b* that flow against upstream direction 38 (i.e. in a downstream direction) past flap 32 and respectively through the portions 28,30 of outlet 18 leading separately into first compartment 22 and second compartment 24.

Figure 5C:
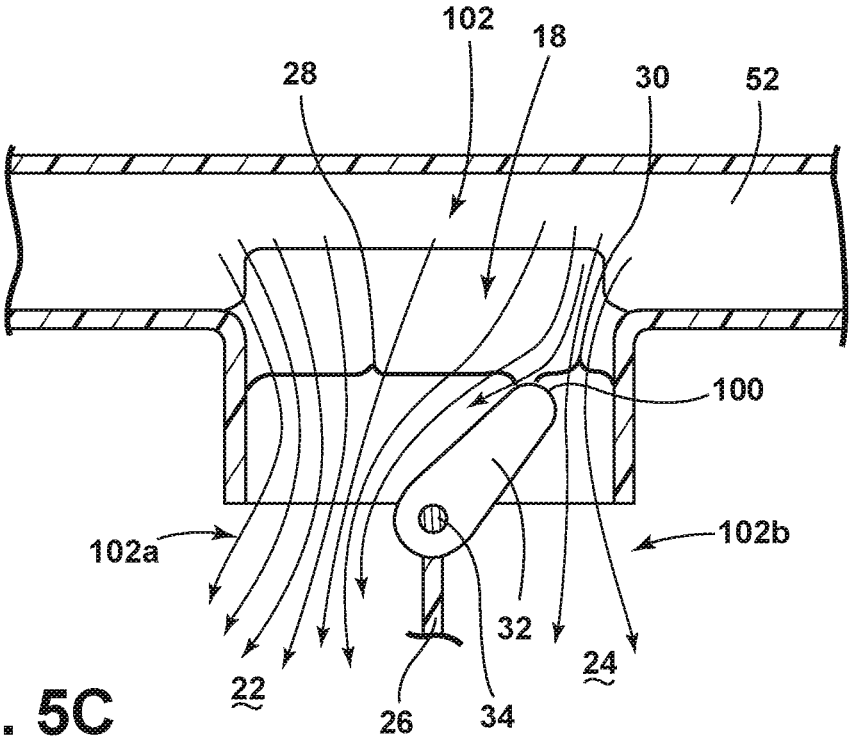

As further shown in FIGS. 5A and 5C, rotation of control element 40 (FIG. 4) in either the clockwise direction 104 or counter-clockwise direction 106 from the centered position, causes the above-described rotation of flap 32 within outlet 18. In this manner, endpoint 100 of flap 32 is moved laterally within outlet 18 in the direction opposite the rotation of control element 40. As shown in FIG. 5C this lateral movement of endpoint 100 changes the relative sizes of the portions 28,30 of outlet 18. In this manner, rotation of the control element 40 in the counter-clockwise direction 106 rotates flap 32 in the clockwise direction 104, thereby moving endpoint 100 away from first compartment 22. As shown, the movement of endpoint 100 away from first compartment 22 increases the size of the first portion 28 of outlet 18 associated with first compartment 22 relative to the second portion 30 associated with second compartment 24. In this manner, the amount of the air flow 102 within the portion 102*a* thereof directed by flap 32 into first compartment 22 is greater than the portion 102*b* left flowing into second compartment 24. This uneven chilled air of flow portion 102*a* results in first compartment 22 being cooled to a greater extent than second compartment 24 proportionately to the amount by which control element 40 is turned. In a similar manner, rotation of control element 40 in the clockwise direction 104 results in a greater air flow portion 102*b* to second compartment 24 and greater cooling thereof.

As can be appreciated, both the sizing of flap 32, in particular the distance between articulation point 34 and endpoint 100, as well as the rotation thereof permitted by the particular configuration of post link arm 94 and control link arm 96 can be varied relative to the size of outlet 18 to provide a desired range and resolution for the adjustment of relative air flow portions 102*a* and 102*b* for first compartment 22 and second compartment 24. In particular, with a given rotational range of flap 32 from the centered position in either direction, which in an example may be between about 20 degrees and about 45 degrees, the endpoint 100 of flap 32 can be adjusted relative to the articulation point 34 to move endpoint 100 closer to or farther from contact with the adjacent portion of outlet 18 at the maximum rotated position. In an embodiment where endpoint 100 of flap 32 contacts the side of outlet 18 in a maximum rotated position, the corresponding compartment 22 or 24 would be generally cut off from air flow 102, which may not be desired. Accordingly, flap 32 can be sized thusly to allow some portion of air flow 102*a* or 102*b* to flow into both compartments 22 and 24 throughout the entire range of motion for flap 32 achievable through rotation of control element 40. In this manner, the relative split of air flow 102 between air flow portions 102*a* and 102*b* can be made to vary between 50/50 (i.e. a 1:1 ratio) to, for example, 60/40, 80/20, or the like according to the principles described herein.

It is further noted that the above configuration of housing subassembly 14, including sliding shelves 64 and 66, as well as covers 74 and 76 can be substituted for other structures adapted to engage with (and optionally be supported by) divider unit 20 for distribution of air flow portions 102*a* and 102*b* by the mechanism described herein. In one example, sliding bins can be substituted for shelves 64 and 66 and the associated covers 74 and 76. In another example, shelves 64 and 66 may be fixedly mounted with divider unit 20 with covers 74 and 76 being independently movable to allow access to the associated compartments 22 and 24.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A compartment assembly for a refrigerator defining a refrigerator interior, comprising:

a housing subassembly defining an enclosed area within and smaller than the refrigerator interior;

an air column including a conduit extending into the interior compartment within the enclosed area and defining a single rectangular air outlet in direct fluid communication with the enclosed area; and a divider unit separating the enclosed area into first and second compartments, the divider unit including:

a central wall positioned within the enclosed area and outside of the conduit, aligned with the air outlet, and exposing respective portions of the air outlet to the first and second compartments;

a flap directly mounted on the central wall, rotatable about an articulation axis external to the conduit and vertically aligned with the central wall, and with a body of the flap extending in an upstream direction through the air outlet and into the conduit; and a control element mounted on a face of the divider unit and having a body external to the enclosed area and operably coupled with the flap to drive rotation thereof.

2. The compartment assembly of claim 1, wherein the housing subassembly includes first and second shelves mounted to respective sides of the divider unit.

3. The compartment assembly of claim 2, wherein the housing subassembly further includes first and second covers rotatably coupled on respective sides of the divider unit and moveable between closed positions contacting respective front edges of the first and second shelves and extending away therefrom perpendicular to the first and second shelves and open positions spaced apart from the first and second shelves.

4. The compartment assembly of claim 1, wherein the housing subassembly includes a plurality of horizontal members positionable within an interior of a refrigerator such that the plurality of horizontal members separate a portion of the interior to define the enclosed area within the interior.

5. The compartment assembly of claim 1, wherein the outlet is positionable in fluid communication with a chilled air source of a refrigerator.

6. The compartment assembly of claim 1, wherein the divider unit further includes a post having a body rigidly coupled with the flap at the articulation point to mount the flap within the air outlet, the post extending within an interior of the divider unit.

7. The compartment assembly of claim 6, wherein:

the post further includes a first link arm extending perpendicularly from the body; and the control element includes a knob mounted on a housing of the divider unit and rotatable about an axis extending perpendicular to the post and a second link arm extending perpendicular to the axis and slidably engaged with the first link arm.

8. The compartment assembly of claim 1, wherein the flap is rotatable within the air outlet into a central position wherein the body of the flap is parallel with the central wall and an endpoint of the body opposite the articulation point separates the air outlet into first and second portions that are equal in area.

9. The compartment assembly of claim 8, wherein the flap is rotatable from the central position such that the endpoint of the body moves within the air outlet such that the first and second portions have different respective areas.

10. The compartment assembly of claim 9, wherein the different respective areas of the first and second portions of the air outlet divide a flow of air through the air outlet into first and second air flow portions respectively into the first and second compartments in proportion to the different respective areas.

11. A refrigerator, comprising:

an interior including a first enclosed area within a portion of the interior, the first enclosed area being smaller than the interior;

a chilled air source providing a flow of chilled air to the interior;

an air column including a conduit extending into the interior compartment within the enclosed area and defining a single rectangular air outlet in direct fluid communication with the air source and with the first enclosed area; and a divider unit separating the first enclosed area into first and second compartments, the divider unit including:

a central wall positioned within the enclosed area outside of the conduit, aligned with the air outlet, and exposing respective portions of the air outlet to the first and second compartments;

a flap directly mounted on the central wall, rotatable about an articulation axis external to the conduit and vertically aligned with the central wall and with a body of the flap extending in an upstream direction through the air outlet and into the conduit; and a control element mounted on a face of the divider unit external to the first enclosed area and operably coupled with the flap to drive rotation thereof.

12. The refrigerator of claim 11, wherein:

the interior is partially defined by a liner within the refrigerator, the refrigerator further including a housing subassembly at least partially defining the first enclosed area with adjacent portions of the liner; and the divider unit is included within the housing subassembly.

13. The refrigerator of claim 12, wherein:

the housing subassembly includes a plurality of horizontal members positionable within the refrigerator interior between the adjacent portions of the liner to separate the first enclosed area from remaining portions of the interior; and the divider unit extends perpendicularly with at least one of the plurality of horizontal members.

14. The refrigerator of claim 11, wherein the air column is in fluid communication with the chilled air source and comprises a plurality of vents within the interior.

15. The refrigerator of claim 11, wherein the divider unit further includes a post having a body rigidly coupled with the flap at the articulation point to mount the flap within the air outlet, the post extending inwardly within the divider unit.

16. The refrigerator of claim 15, wherein the post further includes a first link arm extending perpendicularly from the body, the control element including a knob mounted on a housing of the divider unit and rotatable about an axis perpendicular to the post and a second link arm extending perpendicular to the axis and slidably engaged with the first link arm.

17. The refrigerator of claim 11, wherein the flap is rotatable within the air outlet into a central position wherein the body of the flap is parallel with the central wall and an endpoint of the body opposite the articulation point separates the air outlet into first and second portions that are equal in area.

18. The refrigerator of claim 17, wherein the flap is rotatable from the central position to move the endpoint of the body within the air outlet such that the first and second portions have different respective areas.

19. The refrigerator of claim 18, wherein the different respective areas of the first and second portions of the air outlet divide a flow of air through the air outlet into first and second air flow portions respectively into the first and second compartments in proportion to the different respective areas.

20. A divider assembly for a refrigerator compartment including an air column including a conduit extending into the refrigerator compartment and defining a single rectangular air outlet in direct fluid communication with the air column, comprising:

a central wall outside of the conduit and aligned with the air outlet;

a flap directly mounted on the central wall, rotatable about an articulation axis external to the conduit and vertically aligned with the central wall, and with a body of the flap extending in an upstream direction through the air outlet and into the conduit; and a control element mounted on a face of the divider assembly and operably coupled with the flap to drive rotation of the flap within the air outlet into a central position wherein the body of the flap is parallel with the central wall and an endpoint of the body opposite the articulation point separates the air outlet into first and second portions that are equal in area and from the central position such that the endpoint of the body moves within the air outlet such that the first and second portions have different respective areas.

* * * * *